US006898855B2

(12) United States Patent
Jones et al.

(10) Patent No.: US 6,898,855 B2
(45) Date of Patent: May 31, 2005

(54) ERGONOMIC SCRAPER

(76) Inventors: Gordon Sinclair Jones, 215 N. Harvard St., Allston, MA (US) 02134; John Darrin Fiegener, 24 Jersey, Marblehead, MA (US) 01945; Jason A. Morris, 288 Main St. Apt. #305, Melrose, MA (US) 02176

( * ) Notice: Subject to any disclaimer, the term of this patent is extended or adjusted under 35 U.S.C. 154(b) by 174 days.

(21) Appl. No.: 10/065,940

(22) Filed: Dec. 2, 2002

(65) Prior Publication Data

US 2004/0103542 A1 Jun. 3, 2004

(51) Int. Cl.[7] ..... B26B 1/08
(52) U.S. Cl. ..... 30/169; 30/125; 30/335
(58) Field of Search ..... 30/169, 162, 335, 30/125, 30; 15/236.01

(56) References Cited

U.S. PATENT DOCUMENTS

| | | | | | |
|---|---|---|---|---|---|
| 5,433,004 | A | * | 7/1995 | Thompson et al. | 30/169 |
| 6,374,496 | B1 | * | 4/2002 | Hsu | 30/162 |
| 6,647,629 | B2 | * | 11/2003 | Farland | 30/329 |
| 2003/0024124 | A1 | * | 2/2003 | Tseng | 30/162 |

* cited by examiner

*Primary Examiner*—Douglas D Watts
(74) *Attorney, Agent, or Firm*—Jeffery Furr

(57) ABSTRACT

A scraping tool employing a sharp-edged blade comprising a top, bottom, door, carrier, blade, storage box and an ergonomic base grip. The top, bottom and base grip combine to form the scraper tool body. The blade is attached to the carrier which is contained within the body and slides back and forth allowing the blade to be exposed. The storage box is contained within the body and can be used to store spare and used scraper blades.

12 Claims, 12 Drawing Sheets

ERGONOMIC SCRAPER

BACKGROUND OF INVENTION

This invention relates generally to scraping tools of the type that employ replaceable sharp-edged blades such as razors, utility and wallpaper blades and more particularly those utilizing a storage area and are ergonomically designed.

1. Background

A wide variety of prior art tool heads and blade clamps exist in the field of this invention. Some examples of prior art include, generally, clamps having two jaws, or lips, that are attached to each other by one or more screws, thus necessitating a screwdriver or some other suitable implement to assemble or replace a blade. Such clamps may retain the blade solely by the friction resulting from the clamping force, or, as in some models, by one or more interlocking detents in one of the clamping surfaces that engage a mating hole or holes in the blade. These types of clamps are usually found on wallpaper shaving tools.

The design of these types of tools makes the removal and replacement of blades inconvenient. In order to replace a worn blade, a user must have another tool such as a screwdriver or Allen wrench to loosen the attachment screw (s). Once the screw(s) are loosened, the blade is released and there is an increased probability that the blade will fall from the clamp onto the floor or ground. The user must then pick it up for safe disposal. The screw(s) can also be inadvertently loosened so much that they fall out of the clamp onto the floor or ground, increasing the probability of their becoming lost. This results in wasted time finding the lost or a new screw or, if not found, the user might unsafely or inefficiently operate the scraper with less screws than designed. Also most scrapers are made of metal with the sliding or loading of a metal blade into a metal holder can be difficult. The metal on metal does not often slide easily thus requiring a user to push the blade against a solid object like a table or wall putting tension and wear on the blade and creating a very unsafe situation for the user, this can even cause the blade to break. There are some devices that have a side loading of the blades but they require mulitple steps and locking procedures. There is a need of an easy one touch loading of a blade.

Further, some users tend to hold the tool up in the air with one hand while tightening or loosening the screws with the other. It's possible even to cradle the clamp in either hand so as to employ the thumb and forefinger as guides for the edges of the blade, maintaining its position and alignment while the clamp is loose. Users could more easily lose their grip on the screwdriver of the scraping tool when handling it in this manner, resulting in bodily injury.

There are many other types of prior art clamps for utility, razor, window scraper and other styles of blades employed in scraping tools, all having deficiencies of one type or another, as noted in the ensuing descriptions. Many do not have a place where you can store extra blades for easy accessibility. There needs to be an area that is reaccessible.

Most prior art scraping tools are made of metal which can be slippery when wet oand unconferable to hold of long periods. The metal also presents problems when there are changes in the weather such as cool and heat. When it is cool the metal is cold to the hand and can become brittle. When it is hot, the metal can burn the hand.

The absence of a storage place for extra blades on most scrapers, and the location/lack of inaccessability of the storage areas on those that do have them presents a problem. If a blade breaks or gets dull in the middle of a project it can take time to go and get a blade and replace. Spare blades have to be stored carefully as they can be a safety hazard and they also need to be easily accessible. For those few scrapers the have storage areas, many of those you need to have an extra tool like a screw driver to open the scraper up to get to the extra blades. Other storage areas are designed to handle either packed or single blades, both not both. Some have a swivel opening, turning a single connecting point in the handle making it more difficult to hold the scraper while changing the blade. Many of these require you to remove the blades from their packaging.

These prior scraping tools were not ergonomically designed so that using them can cause strain on the user and may even cause repetitive motion damages. The lack of an ergonomic design makes it harder for a person to use the scraping tool.

2. Description of Prior Art

There have been various types of scrapers designed over the years. In using a scraper that utilizes a razor blade, it is important that the bare blade be covered when the scraper is not in use in order to prevent the bare blade from injuring someone and to protect the blade edge. Therefore, some prior scrapers place a blade in a retractable holder so that when the blade is not in use, the holder with the blade is retracted within a casing so as to hide the blade. Other scrapers have used protective covers which are pivotally moved to a position to hide the exposed blade edge. Still other scrapers have covers which are moved over the blade and are locked in place by tightening a set screw or some other device. Examples of these scrapers are shown and described in U.S. Pat. Nos. 2,336,284, 2,580,182 and 3,667,122.

U.S. Pat. No. 4,575,936 issued Mar. 18, 1986, titled "Blade Retaining Tool Head" attempts to remedy the hazard and inconvenience of the prior art screw-type clamp. This is done by employing interlocking, pivoting clamp-halves that are actuated by a threaded handle which engages mating threads in each clamp-half. A filled-in thread in one of the clamp-halves augments a camming action that forces the two halves together to grip an inserted blade when the handle is fully tightened. This eliminates the need for screws and a screwdriver or other tools to perform this function.

The U.S. Pat. No. 4,575,936 patent, however, provides no means for retaining the blade while the clamp is being actuated, perpetuating the potential hazard caused by a user's tendency to guide the edges of the blade into alignment with the clamp with one hand while tightening or loosening the threaded handle with the other.

Additionally, the amount of clamping force imposed on the blade, and thus the magnitude of the retaining friction force, depends on the degree of tightening-torque applied to the handle by the user and, of course, the amount of wear on the resilient cylinder. Whether by inexperience, insufficient strength or lack of intuitive insight, the user may fail to apply enough torque to the handle to sufficiently clamp the blade for all aspects of its intended use. Also, when loosening the clamp to change blades, the user may, for the same reasons, inadvertently disassemble the handle from the clamp-halves; an inconvenience, at the least.

U.S. Pat. No. 5,056,226 issued Oct. 15, 1991, titled "Tool For Carrying a Scraping or Stripping Blade" specifies a two-piece device incorporating a pivot able, lever-actuated blade clamp. The U.S. Pat. No. 5,056,226 patent requires no auxiliary tool, such as a screwdriver, to install or remove a blade.

But as in the U.S. Pat. No. 4,575,936 patent, the U.S. Pat. No. 5,056,226 patent provides no means for containing or restraining the blade during the period between the time it is placed in the clamp and the time that the lever is latched shut. Hence, the potential inconvenience of a loose blade slipping, or falling from the clamp before it's closed tightly on the blade persists. The tool bearing the U.S. Pat. No. 5,056,226 number includes two detents in the lower, fixed clamp jaw that engage corresponding holes in the blade, offering a limited amount of blade restraint at times when the lever is unlatched. However, this effect is far from positive blade retention. Another class of clamps for scraping applications are those that incorporate retractable slides upon or within which the blade is placed or inserted.

U.S. Pat. No. 4,955,138 issued Sep. 11, 1990 titled "Utility Blade Scraper" incorporates a thumb button actuated trigger and slide, lockable in three positions: (1) fully retracted; (2) working position (partial extension) and (3) blade changing position (full extension).

The blade is loaded in the latter position by placing it on the extended slides; a central hole in the blade engaging the slide's mating detent. Additionally, two "lugs" on the slide engage slots in the back edge of the blade. Upon first placing the blade on the slide it will tend to stay in place as long as the handle is held horizontally, but otherwise may become dislodged and fall, resulting in lost or damaged blades and wasted time and inconvenience. Also, the blade may require some guidance by the user as it is retracted through the blade slot opening. The back edge of the blade may tend to hang-up on the upper edge of the slot, or, in some instances, so may the blade positioning detent. Once retracted into the confines of the slot, the blade is contained by the upper and lower internal surfaces of the slot.

Finally, there's the common razor blade scraper with a myriad of forms and styles. The types most relevant to the field of this invention are the retractable varieties as exemplified by Harry Warner et al U.S. Pat. No. 2,291,514 issued Jul. 28, 1942, Donald Gringer U.S. Pat. No. 4,558,517 issued Dec. 17, 1985 and Leon Lavallee, et al Pat. No. D346,319 issued Apr. 26, 1994.

There are numerous scraping tools on the market, many of which are the subject matter of patents. Such patents include: U.S. Pat. Nos. 6,334,254, 6,286,215, 6,253,454, 6,101,721, 5,996,231, 5,924,203, 5,713,232, 5,528,832, 5,493,781, 5,433,004, 5,319,853, 5,235,751, 5,181,320, 5,095,573, 5,009,099, 4,979,300, 4,558,517, 4,238,883, 4,182,033, D396,910, D389,966, D386,846, D383,577, D358,011, D346,319, D338,822, D362,093, D282,881 and D274,953. Yet these patents do not solve the need for a scraping tool that allows the blade to be replaced easily while having a storage compartment for blades while being ergonomically designed.

For the foregoing reasons, there is a need for a scraping tool with easy one touch loading and replacing the blade, easy to access storage compartment, made of a two components plastic and ergonomic design.

SUMMARY OF INVENTION

The present invention relates to a retractable blade scraper which utilizes a scraping blade for removing paint, glue, caulking, adhesives, tape, stickers or other materials from surfaces, particularly, hard, smooth surfaces, such as glass and tile.

Accordingly, it is an object of the present invention to provide a scraping tool that does not exhibit the disadvantages, inconveniences or potential pitfalls from use of the prior art devices previously described. It is another object of the present invention to provide a scraping tool that requires no auxiliary tool or other implement to assemble, remove or replace a blade. It is a further object of the present invention to provide a scraping tool that has a storage area to store blades that are easy to access and re-access without using any auxiliary tools. An additional object of the present invention is to provide a scraping tool that is ergonomically designed that allows for maximum control and gripablity with a comfort fit into the hand. One that matches the primary hand positions used to hold and use the scraper.

An additional object of the present invention is to provide a scraping tool the is comprised of two-component plastic materials, such as a hard and soft plastic, like thermo-plastic and elastomer.

An additional object of the present invention is to provide a safety feature of a ribbed indention and safety wall on the top for a better hold and safety. In order to achieve the above objectives, as well as others that will become apparent hereinafter to those skilled in the art, a scraping tool in accordance with the present invention comprises five major components excluding the blade. These major components are the bottom, the top with a storage box, the carrier, the door and the ergonomic base grip.

The door is attached to the bottom and opens out for accessing the storage box, with the storage box being used to hold extra blades. The carrier is used to hold the blade and has the ability to slide in and out of the scraper body with a tab extending out of the scraper body on the top. The scraper body is formed of the bottom, top and base grip with the storage box being contained within the scraper body.

These, together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment.

BRIEF DESCRIPTION OF DRAWINGS

Without restricting the full scope of this invention, the preferred form of this invention is illustrated in the following drawings.

DETAILED DESCRIPTION

Figure 1:
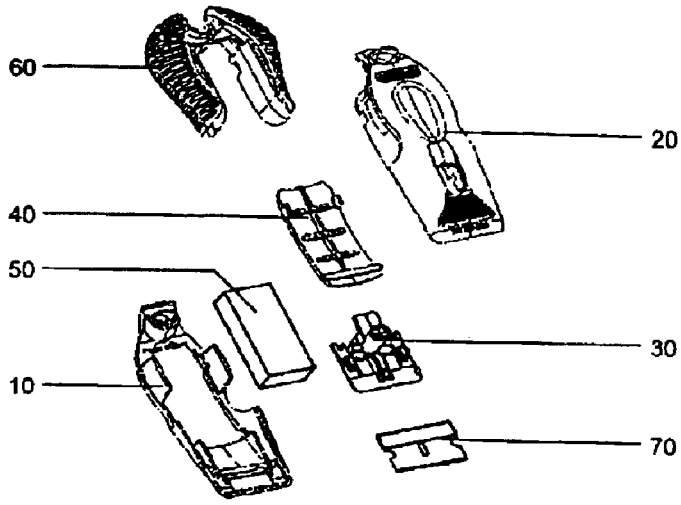
FIG. 1 shows the main components of the device.
Figure 2:
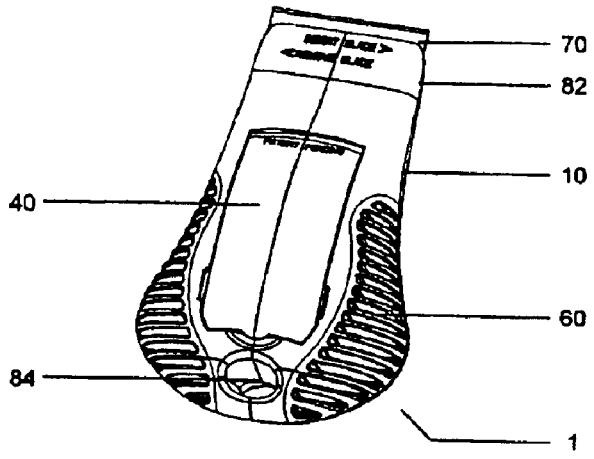
FIG. 2 shows a back perspective view of the device showing its ergonomic.
Figure 3:
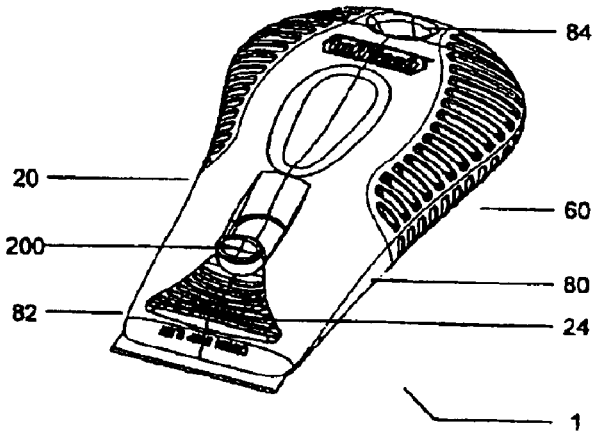
FIG. 3 shows a front perspective view of the device showing its ergonomic design.
Figure 4:
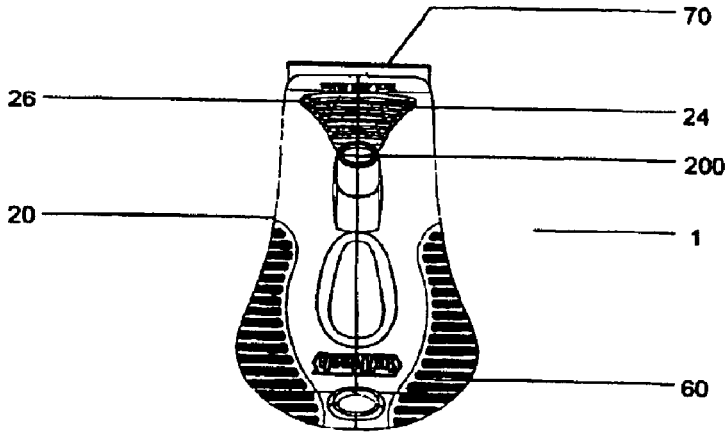
FIG. 4 shows a top view of the device.
Figure 5:
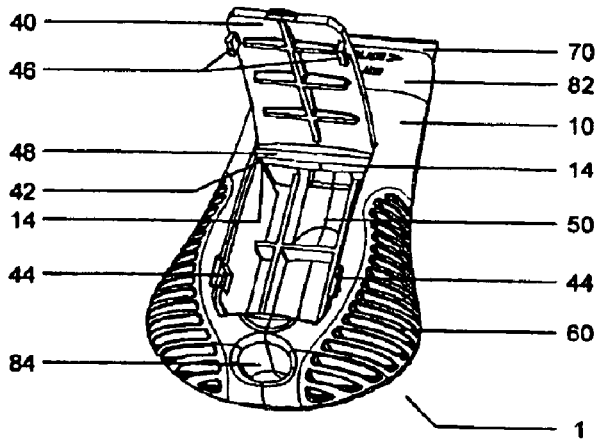
FIG. 5 shows a bottom view of the device.
Figure 6:
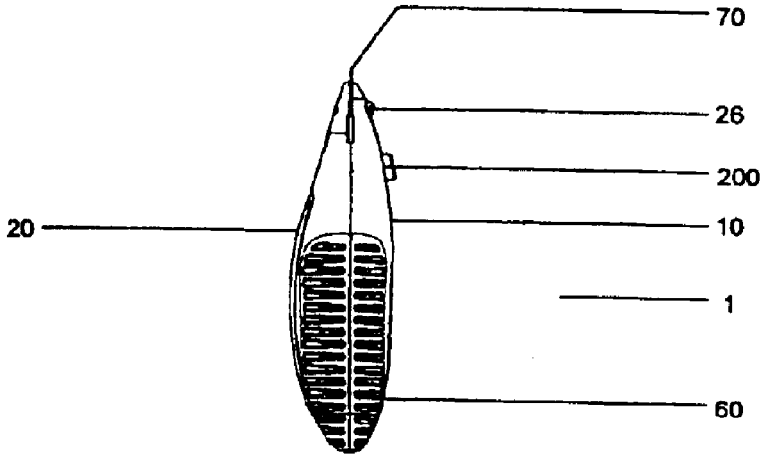
FIG. 6 shows a side view of the device.
Figure 7:
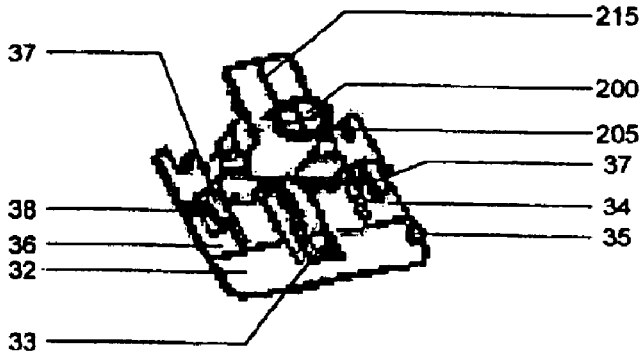
FIG. 7 shows the carrier and the carrier tab of the device.
Figure 8:
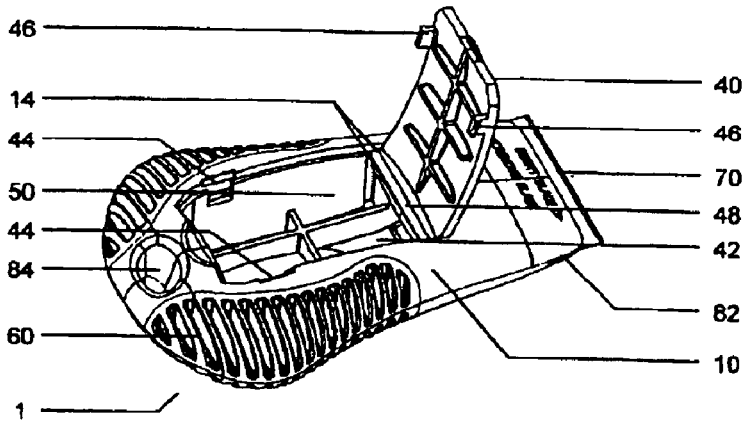
FIG. 8 shows a view of the bottom with the door open to reveal the storage box.
Figure 9:
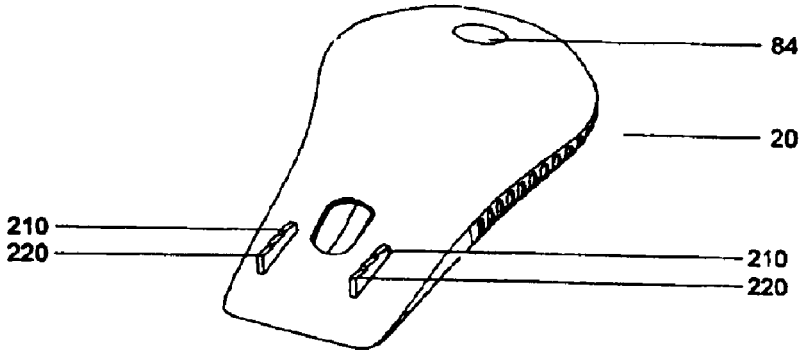
FIG. 9 shows the carriage detents.

The following description of a retractable blade scraper is demonstrative in nature and is not intended to limit the scope of the invention or its application of uses.

Referring to the drawings, specifically FIGS. 1 through 12, there is illustrated an embodiment of a retractable ergonomic blade scraper with storage area 1 (hereinafter "device") adapted for use with a blade 70. The present invention comprises six major components excluding the blade. These major components are the bottom 10, the top 20 with a storage box 50, the carrier 30, the door 40, and the ergonomic base grip 60.

Figure 10:
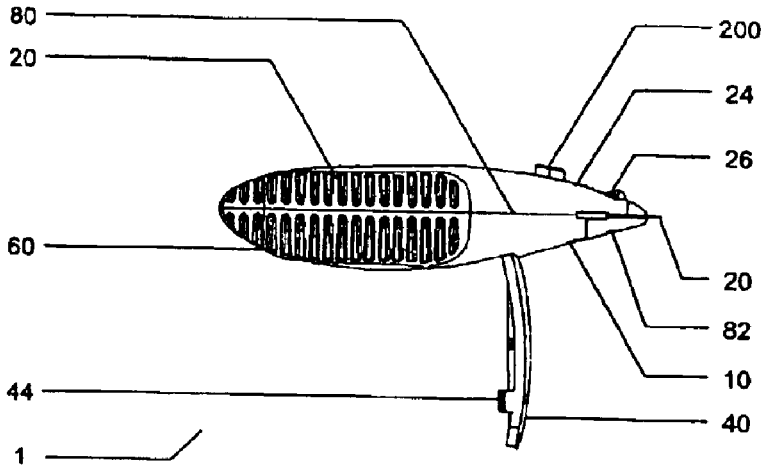
FIG. 10 shows a side view of the device with the door open.
Figure 11:
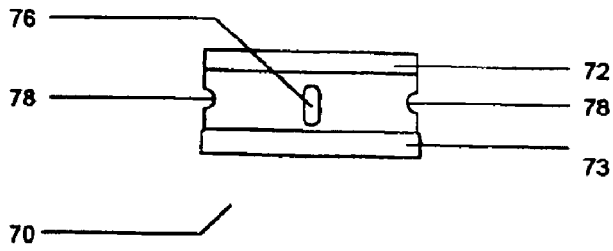
FIG. 11 show the blade.

As shown in FIG. 10 and the other Figs, the door 40 is attached to the bottom 10 and opens out for accessing the storage box 50, with the storage box 50 being used to hold extra blades 70 and being part of the top 20. The carrier 30 is used to hold the blade 70 and has the ability to slide in and out of the scraper body 80 with a tab 200 extending out of the scraper body on the top 20. The scraper body 80 is formed of the bottom 10, top 20 and base grip 60 with the storage box 50 being contained within the scraper body 80.

The device 1, in the preferred embodiment, is made of a combination of a hard and soft plastic, like thermoplastic and elastomer respectively with the base grip 50 being made of the soft plastic and the rest of the device 1 being made of the hard plastic.

The Scraper Body

The scraper body 80 is formed of the bottom 10, top 20 and base grip 60 with the storage box 50 being contained within the scraper body 80. The top 20 and the bottom 10 fit together to form the scraper body 80 with the body cavity 90 within. After the top 20 and the bottom 10 are placed together the base grip 60 covers the back of the scraper body 80 on the grip end 100 that is opposite of the blade end 82. The door 40 is attached to the bottom 10 through a hinging means 12. The bottom 10 has a door opening 42 that is the same dimension, although slightly smaller than the door 40. Both the top 20 and bottom 10 are curved towards each other for an ergonomic design and they slope toward the blade side 82 of the scraper body 80. In the preferred embodiment, the body 80 has a length of 4 3/32" from end to end with the blade 70 extended and has a width of 1 1/16" at its widest point. The body 80 has a pear shape from a top and bottom view. This shape is designed to make it more ergonomic. The body 80 has an oval opening 84 opposite the blade end 82. This oval opening 84 allows the device 1 to be connected to ties or hung up on hooks or nails.

The Bottom

The Bottom 10 is curved in shape. It has a bottom carriage ledge 16 on which the carriage 30 slides. It has a door opening 42. On one side of the door opening 42 are two hinge slots 14. These hinge slots 14 are on opposite sides of the door opening 42 and are what the door hinging means 12 set into allowing the door 40 to swing open and close. The bottom 10 has a set of door closing tabs 44. These closing tabs 44 extend perpendicular from the door opening 42 towards the inner side of the bottom 10. In the preferred embodiment, there are two closing tabs 44 on opposite sides of the door opening 42. These closing tabs 44 and 46 are used by the door secure hooks 46 that are located on the door 40 to secure the door 40 closed. The oval opening 84 extends through the bottom 10.

The Door

The door 40 has a curved shape that matches that of the bottom 10. The door has a hinging means 12 which in the preferred embodiment would be a cylinder bar 48 that is perpendicular to the door 40, on the interior side of the door 40 and extend slightly beyond the edge of the door 40. The cylinder bar 48 would fit into the hinge slots 14. The top 20 would have a ridge that would cover the hinge slots 14 securing the door 40. The door 40 would have door secure hooks 46 that secure the door 40 closed by hooking on the closing tabs using tension. The door will have a lip that is used to assist in the opening of the door 40 from a closed position.

The Top

The Top 20 is curved shape. It has a tab opening 22 from which the tab 200 of the carriage 30 extends. The top 20 fits against the bottom 10 to form the body cavity 90. The oval opening extends through the top 20. The top 20 has the detent-receiving notches 210 and 220 for the positioning of the carriage 30 for the blade storage and scraping/loading positions. These detent-receiving notches are on the body cavity 90 side. It has a top carriage ledge 18 on which the carriage 30 slides. The storage box 50 is a rectangular box-like structure that is the body cavity 90. In the preferred embodiment, the storage box 50 is part of the top 20, but in the alternative the storage box 50 can be part of the bottom 10 or its own component. The storage box 50 can be used to store unused and used blades 70 with the preferred size being such that matches the blades 70. The door 40 opens to allow the user access to the storage box 50.

The top 20 has a ribbed area 24 and a safety wall 26. The ribbed area 24 is an indented area with ribs rising from the surface of the indented area. These ribs and indention help the user's grip on the device 1 and acts as a thumb hold. The ribbed area 24 is positioned on the top of the top 20 opposite the cavity side and it right after the hole for the thumb button 200 towards the blade end 82. At the end of the ribbed area 24 as you head towards the blade end 82 is the safety wall 26. The safety wall 26 a raised up area from the surface of the top 20. It is used to prevent the user's thumb from slipping towards the blade.

The Base Grip

The base grip 60 is designed to assist the user in holding and using the device 1 and increase the device's 1 ergonomic design. The base grip 60 is in a half circle shape with extended sides and covers the back side 84 opposite the blade slide 82 of the scraper body 90. The base grip 60 is made of a strong, durable, friction resistance material such as a soft plastic like elastomer. The base grip 60 in the preferred embodiment will have ridges that will assist in the gripping of the device 1.

Blade Movement

The carriage 30 and the scraper body 80 cooperate as follows: The carriage 30 is slid ably received in the scraper body 80 and normally retained for longitudinal reciprocation therein between a forward most scraping/blade-changing position and a rearward most blade-storage position. In one embodiment, the carriage 30 is selectively lockable in at least its blade-storage and scraping/loading positions. The longitudinal reciprocation of the carriage 30 between its blade-scraping and blade-storage positions, and the locking thereof into at least the storage and scraping positions, is facilitated by a thumb button 200 that is accessible from the exterior of the top 20 and connected to the remainder of the carriage 30 by a resilient lever 205 as shown, for example, in FIG. 7. Extending from the resilient lever 205 is a slide-locking detent 215 which is movable into and out of the detent-receiving notches 210 and 220 in the scraper body 80 between a locking position and a sliding position. In the version shown in FIG. 9, the detent-receiving notches 210 and 220 correspond to the blade storage and scraping positions respectively. The resilient lever 205 is biased so as to maintain the slide-locking detent 89 in one of the detent-receiving notches 210 and 220 (i.e., in the locking position).

The thumb button 200 is depressible, and the resilient lever 205 flexible, in a longitudinal direction toward the bottom of the body 80 into the sliding position in which the slide-locking detent 215 is disengaged from the detent-receiving notches 210 and 220 so that the carriage 30 can be longitudinally reciprocated forward and backward within the body 80.

The Blades

In the preferred embodiment, the type of blade 70 used is a standard rectangular single edged razor blade, but the device 1 can be modified to use a trapezoidal utility blade or any other type of standard and non-standard blade and still be within the scope of the current invention. However, these dimensions are offered by way of example, blade shapes and dimensions should not be interpreted as limitations on the scope of the invention as disclosed and claimed.

The Carriage

One embodiment of a scraper 1 is adapted for use with a substantially flat, rectangular razor blade 70 having two opposed flat surfaces, a forward scraping edge 72, a rear edge 73, which is opposite and parallel to the forward scraping edge 72, rear ridge 74, center opening 76 at the center, and indenting side edges 78. The configurations illustrated are common industry examples.

The blade 70 is irremovably mountable on a blade seat 32 of the carriage 30. As illustrated best in FIG. 9, the blade seat 32 has a blade platform 34, a blade indent 36 and a rear wall 38 for receiving and supporting one of the flat surfaces of the blade 70 and the rear edge 73 of the blade 70, respectively. The blade platform 34 is preferably provided with at least one blade-retaining tab 35 designed to project through and engage at least one indenting side edge 78 to prevent the blade 70 from sliding relative to the blade platform 34. Also assisting in this restraining function is blade clip 39 which, in this case, project forward from the rear wall 38 angled down toward the blade with a rounded end pressing down in the center opening 76. In the preferred embodiment, there is an opening 33 in the blade seat 32 underneath the blade clip 39. The carriage 30 has two blade positioners 37 which extend out of the rear wall 38 to hold the blade 70 in place.

Extending upwardly from the blade seat 52 is a substantially rigid resilient lever 205. The thumb button 200 is connected to the resilient lever 205 opposite the blade platform 34. The blade clip 39 holds the blade 70 into place.

Blade Loading

Figure 12:
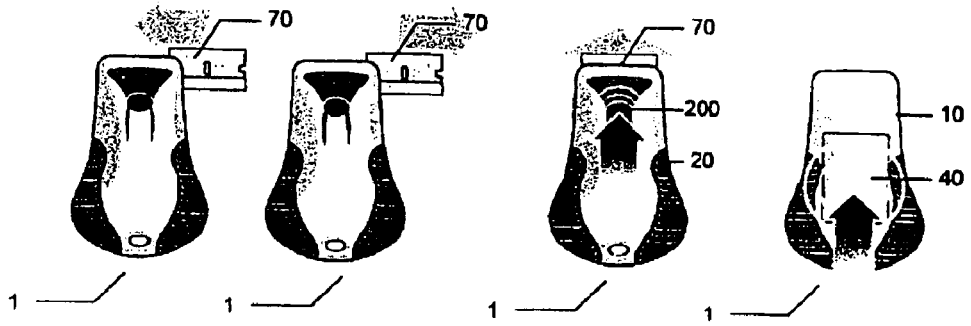
FIG. 12 shows the blade loading process.

As shown in FIG. 12, the device has a slide loading of the blades 70. The blade 70 is placed next to the device 1. The blade is slide into the carriage 30. The blade's 70 ridge placed in the blade seat 32 against the rear wall 38 in the blade indent 36. The blade is slide until the blade indenting side edge 78 engages with the blade-retaining tab 35.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed.

Alternative Embodiment The device, in an alternative embodiment, is made of a combination of a hard and soft plastic like above, such as thermo-plastic and elastomer respectively with not only the base grip 50 being made of the soft plastic, having the soft plastic or rubber cover the ribs in the ribbed area 24, the sides of the top 20 and bottom 10, and the thumb button 200 or any combination of such with the rest of the device 1 being made of the hard plastic.

Advantages The previously described version of the present invention has many advantages, including many elements missing in all prior art. It provides a scraper with easy to replace blade, easy to access storage compartment, two component plastic and ergonomic functional construction.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed. Therefore, the point and scope of the appended claims should not be limited to the description of the preferred versions contained herein.

That which is claimed is:

1. A retractable blade scraper comprising: (a) a body where said body being comprised of a hard plastic and a soft plastic; and (b) a carriage; and (c) a door connected to the bottom with a hinging means; said door opening to a storage area contained within said body, where a blade is positioned at the front end of said body so that the scraping end of said blade edge is parallel to the adjacent edge of said body.

2. A retractable blade scraper as in claim 1 where said scraper has an ergonomic design.

3. A retractable blade scraper as in claim 1 where said carriage has two positions, storage and scraping/loading position.

4. A retractable blade scraper as in claim 1 where said storage area is attached to said body.

5. A retractable blade scraper as in claim 1 where said storage area is used to store used and unused blades.

6. A retractable blade scraper as in claim 1 where said top having a ribbed area and a safety wall.

7. A retractable blade scraper comprising: (a) a body having top, bottom and base grip components where a blade is attached to a carriage and is positioned at the front end said body so that the scraping end of said blade edge is parallel to the adjacent edge of said body; (b) said top and bottom being comprised of a hard plastic; (c) said grip being comprised of a soft plastic; and (d) a door is connected to the bottom with a hinging means; said door opening to a storage area contained within said body.

8. A retractable blade scraper as in claim 7 where said top having a ribbed area and a safety wall.

9. A retractable blade scraper as in claim 7 where said scraper has an ergonomic design.

10. A retractable blade scraper as in claim 7 where said carriage has two positions, storage and scraping/loading position.

11. A retractable blade scraper as in claim 7 where said storage area is attached to said body.

12. A retractable blade scraper as in claim 7 where said storage area is used to store used and unused blades.

* * * * *